US007377007B2

(12) United States Patent
Best

(10) Patent No.: US 7,377,007 B2
(45) Date of Patent: May 27, 2008

(54) VACUUM CLEANER WITH DETACHABLE VACUUM MODULE

(75) Inventor: Michael F. Best, Rockford, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 74 days.

(21) Appl. No.: 10/598,472

(22) PCT Filed: Mar. 1, 2005

(86) PCT No.: PCT/US2005/006360

§ 371 (c)(1),
(2), (4) Date: Aug. 31, 2006

(87) PCT Pub. No.: WO2005/084511

PCT Pub. Date: Sep. 15, 2005

(65) Prior Publication Data

US 2007/0226946 A1 Oct. 4, 2007

Related U.S. Application Data

(60) Provisional application No. 60/521,165, filed on Mar. 2, 2004.

(51) Int. Cl.
*A47L 9/16* (2006.01)

(52) U.S. Cl. ..... 15/329; 15/353; 15/410; 55/DIG. 3

(58) Field of Classification Search ..... 15/329, 15/353, 410, 350; 55/DIG. 3, DIG. 10
See application file for complete search history.

(56) References Cited

U.S. PATENT DOCUMENTS

| | | | | |
|---|---|---|---|---|
| 5,309,600 | A | 5/1994 | Weaver et al. | |
| 5,524,321 | A * | 6/1996 | Weaver et al. | 15/329 |
| 6,094,775 | A * | 8/2000 | Behmer | 15/329 |
| 6,311,366 | B1 | 11/2001 | Sepke et al. | |
| 6,457,205 | B1 | 10/2002 | Conrad | |
| 6,574,831 | B2 * | 6/2003 | Hunter et al. | 15/410 |
| 6,684,451 | B2 | 2/2004 | Kato et al. | |
| 6,961,975 | B2 * | 11/2005 | Park et al. | 15/329 |
| 7,188,388 | B2 * | 3/2007 | Best et al. | 15/329 |
| 2002/0011050 | A1 | 1/2002 | Hansen et al. | |
| 2002/0092123 | A1 | 7/2002 | Stephens et al. | |
| 2007/0226946 | A1 * | 10/2007 | Best | 15/329 |

FOREIGN PATENT DOCUMENTS

EP 1279362 A 1/2003

* cited by examiner

*Primary Examiner*—Lee D Wilson
(74) *Attorney, Agent, or Firm*—McGarry Bair PC

(57) ABSTRACT

A multi-use, dual power mode vacuum cleaner (10) that can be used as an upright vacuum cleaner or as a portable, hand-carried vacuum cleaner comprises a detachable vacuum module (16) selectively mounted to an upright handle assembly (12). The detachable vacuum module (16) includes a motor and fan assembly (64) for creating a working air flow, a particle separator (48) for separating dirt form the working air flow and a portable power source (104) for providing power to the motor and fan assembly (64). The particle separator can be a cyclone separator (48) or a bag separator.

22 Claims, 13 Drawing Sheets

VACUUM CLEANER WITH DETACHABLE VACUUM MODULE

CROSS-REFERENCE TO RELATED APPLICATIONS

This application claims priority on International Application No. PCT/US2005/006360, filed Mar. 1, 2005, which claims the benefit of U.S. Provisional Patent Application No. 60/521,165, filed Mar. 2, 2004, all of which is incorporated herein in its entirety.

BACKGROUND OF THE INVENTION

1. Field of the Invention

This invention relates generally to a vacuum cleaner. In one aspect, the invention relates to a vacuum cleaner having a detachable vacuum module comprising a vacuum source and a portable power source for providing power to the vacuum source.

2. Description of the Related Art

A battery powered combination vacuum cleaner that can be converted from a conventional on-the-floor cleaner to a portable canister cleaner for off-the-floor cleaning operation is disclosed in U.S. Pat. No. 6,311,366 to Sepke et al. A dirt cup is positioned in an intermediate portion of an elongated casing including a motor housing. The dirt cup is connected to the motor housing through a removable flat filter that separates debris from the airstream.

A battery powered upright vacuum utilizing a cyclonic separator is disclosed in U.S. Pat. No. 6,457,205 to Conrad. The cyclonic separator is fixed to the upright pivoting handle and can not be removed.

A battery powered stick vacuum cleaner that mates to a separate charging base is disclosed in U.S. Pat. No. 6,684,451 to Kato.

A multi-use vacuum cleaner with a detachable vacuum cleaner module that can be used as an upright vacuum cleaner or as a portable vacuum cleaner is disclosed in U.S. Pat. No. 5,524,321 to Weaver et al., issued Jun. 11, 1996, and U.S. Pat. No. 5,309,600 to Weaver et al., issued May 10, 1994. A detachable vacuum module is selectively mounted to the foot and support member of an upright vacuum cleaner. The vacuum module includes the vacuum motor, motor driven fan, vacuum bag, and hose. The vacuum cleaner can be operated as an upright vacuum, or alternatively, the module can be separated from the foot and upright support member to be used independently of and at a great distance from the foot and upright support member for a wide variety of cleaning purposes.

U.S. Patent Application Publication No. 2002/0011050 to Hansen et al., published Jan. 31, 2002, discloses a suction cleaner with a cyclonic dirt separator comprising a dirt collection assembly including a cyclonic separator having an inlet aperture and an outlet aperture, and a suction source fluidly connected with the cyclonic separator. In one embodiment, the cyclonic dirt separator includes a separator plate cooperating with the housing to separate the cyclonic separator from a dirt collecting cup. The separator plate has an outer diameter smaller than the inner diameter of the dirt tank to create a gap between the outer edge of the separator plate and the inner wall of the cyclonic separator.

SUMMARY OF THE INVENTION

A vacuum cleaner according to the invention comprises a foot assembly having a suction nozzle, an upright handle assembly pivotally mounted to the foot assembly for manipulation of the foot assembly along a surface to be cleaned, and a portable cleaning module detachably mounted to the handle assembly so that the vacuum cleaner can be operated as an upright vacuum cleaner when the portable cleaning module is mounted to the handle assembly or as a portable vacuum cleaner when the portable cleaning module is detached from the handle assembly. The portable cleaning module comprises a module housing, a particle separator mounted to the module housing and having an inlet, a suction conduit having a first end connected to the inlet of the particle separator and a second end removably coupled to the suction nozzle, a motor and fan assembly supported in the module housing for creating a working air flow from the suction nozzle to the particle separator through the suction conduit, and a portable power source coupled to the motor and fan assembly for supplying power to the motor and fan assembly when the portable cleaning module is detached from the handle assembly for operation of the vacuum cleaner as a portable vacuum cleaner.

In one embodiment, the portable power source is adapted to supply power to the motor and fan assembly when the portable cleaning module is mounted to the handle assembly for operation of the vacuum cleaner as an upright vacuum cleaner.

In another embodiment, the portable power source comprises a battery pack. The battery pack can comprise a rechargeable battery.

In another embodiment, the vacuum cleaner further comprises a charging unit mounted in one of the foot assembly and the portable cleaning module and selectively coupled to the portable power source for charging the portable power source. The vacuum cleaner can further comprise a transformer in electrical communication with the charging unit and adapted to connect to a stationary power source for converting alternating current from the stationary power source to direct current for the portable power source.

In a preferred embodiment, the particle separator is a cyclone separator. In another embodiment, the particle separator is a bag filter.

In one embodiment, a vacuum cleaner and charging base assembly comprise a vacuum cleaner as described above and a charging base to which the foot assembly removably docks, the changing base comprising a charging unit that connects to the portable power source for charging the power source when the foot assembly is docked with the charging base.

In another embodiment, the vacuum cleaner further comprises an agitator driven by an agitator motor, both mounted to the foot assembly, and the portable cleaning module comprises an interlock switch in communication with the agitator motor, wherein the interlock switch closes when the portable cleaning module is mounted to the handle assembly to electrically couple the portable power source with the agitator motor. The vacuum cleaner can further comprise a user operated agitator switch between the portable power source and the interlock switch for controlling power to the agitator motor. The vacuum cleaner can further comprise a user operated main power switch between the portable power source and agitator switch. Optionally, the vacuum cleaner can further comprise a lamp mounted to the foot assembly and electrically connected to the interlock switch so that the portable power source supplies power to the lamp when the portable cleaning module is mounted to the handle assembly and the agitator switch is closed.

In one embodiment, the vacuum cleaner further comprises a user operated main power switch between the portable power source and the motor and fan assembly for controlling power to the motor and fan assembly. The vacuum cleaner can further comprise a power cord coupled to the main power switch and having a plug that can be removably coupled to a stationary power source for providing power to the motor and fan assembly. In one embodiment, the power cord is mounted to the portable cleaning module. In another embodiment, the power cord is arranged in parallel relative to the portable power supply.

In yet another embodiment, the cyclone separator further comprises an outlet opening, and the motor and fan assembly comprises an inlet opening connected to the outlet opening of the cyclone separator for drawing the working air flow through the cyclone separator.

In another embodiment, the motor and fan assembly comprises an inlet opening connected to the first end of the suction conduit and an outlet opening connected to the inlet opening of the cyclone separator.

In one embodiment, the foot assembly further comprises an air conduit coupling and a working air conduit coupled to the suction nozzle at a first end and to the air conduit coupling at a second end, and wherein the portable cleaning module further comprises a hose fitting that removably receives the second end of the suction conduit and mates with the air conduit coupling when the portable cleaning module is mounted to the handle assembly to fluidly communicate the suction nozzle with the cyclone separator.

In another embodiment, the portable cleaning module further comprises a dirt cup removably mounted to the module housing to collect particles separated from the working air flow by the cyclone separator. In one embodiment, the dirt cup is mounted below the cyclone separator.

DESCRIPTION OF THE PREFERRED EMBODIMENT

Figure 1:
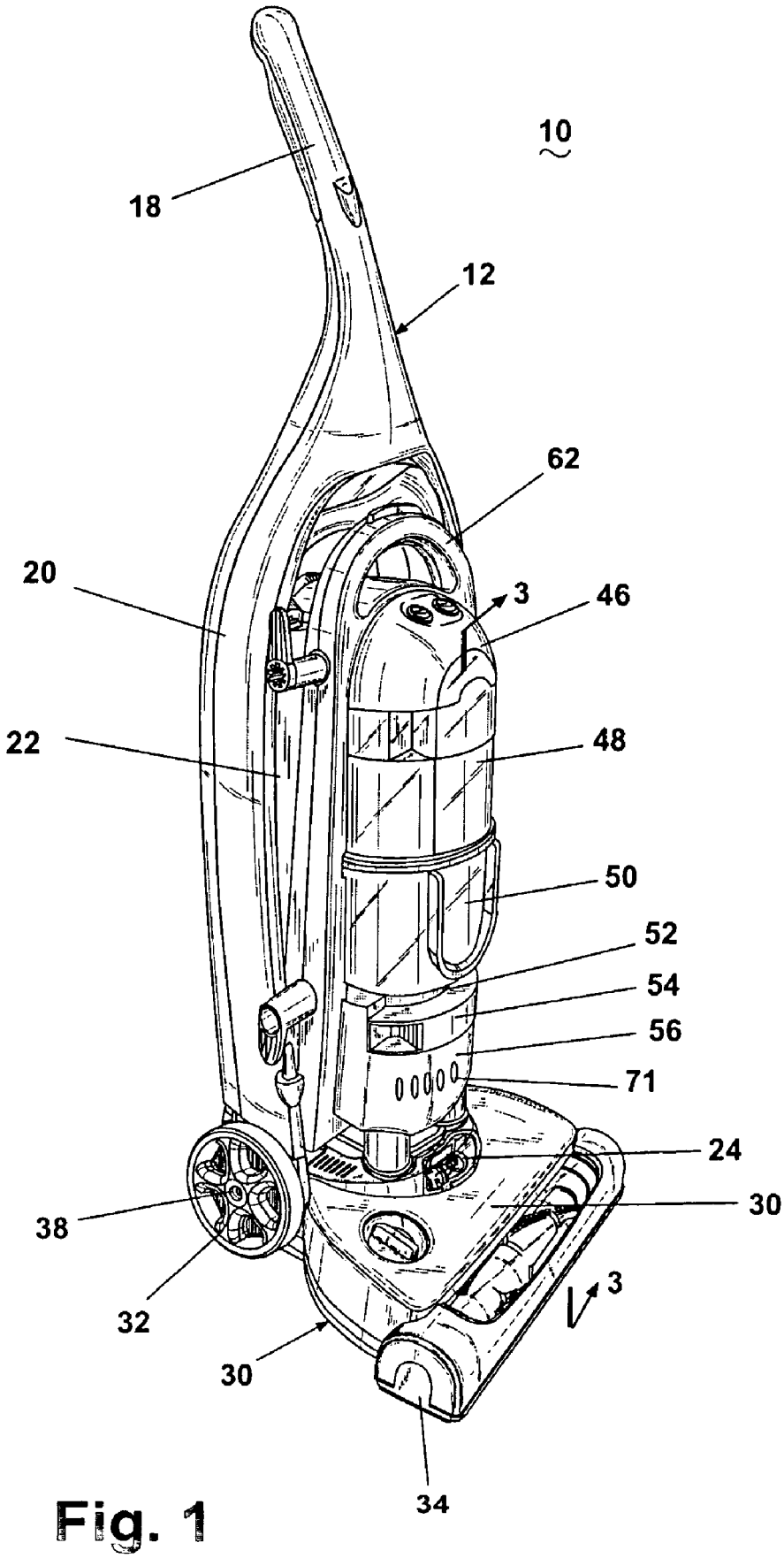
FIG. 1 is a perspective view of a vacuum cleaner having a handle assembly, a foot assembly, and a detachable vacuum module with a cyclonic separator according to the invention.
Figure 2:
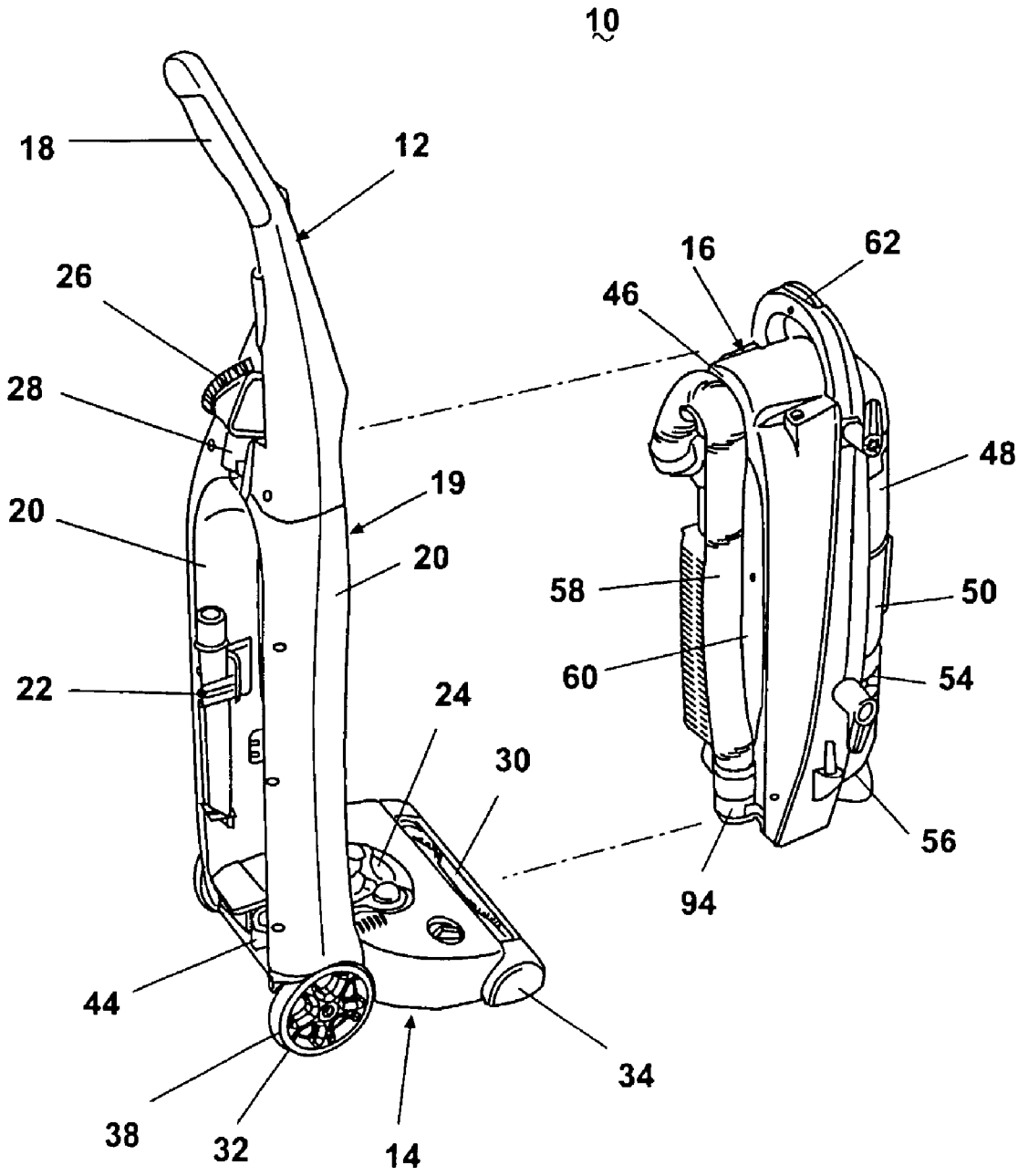
FIG. 2 is a rear perspective view of the vacuum module of FIG. 1 separated from the handle assembly and the foot assembly.

With reference to FIGS. 1 and 2, a vacuum cleaner 10 comprises an upright handle assembly 12 and a foot assembly 14. The upright handle assembly 12 comprises a module platform 24, an elongated structural support 19, and a detachable cyclonic vacuum module 16. The elongated structural support 19 is formed by a pair of spaced apart elongated frames in the form of support tubes 20 that are joined to a grip 18 at an upper portion thereof. The support tubes 20 merge in an arc-like configuration at an upper end of the support tubes 20 and merge into the grip 18. A mechanical stop 22 is positioned approximately midway between a lower end of each support tube 20 and the arc-like configuration. The stop 22 is a block-like structure to provide lateral support for the detachable cyclonic vacuum module 16. The module platform 24 is rigidly attached to the lower ends of the support tubes 20 in a generally perpendicular fashion and supports a lower end of the detachable cyclonic vacuum module 16. Wheel axle bearings (not shown) extend through the lower end of the support tube 20 in a horizontal direction. The upright handle assembly 12 including the module platform 24 rotates about the wheel axle bearings. An upholstery tool 26 is removably attached to a recessed upholstery tool caddy 28 located on an upper rearward surface of the upright handle assembly 12.

Figure 3:
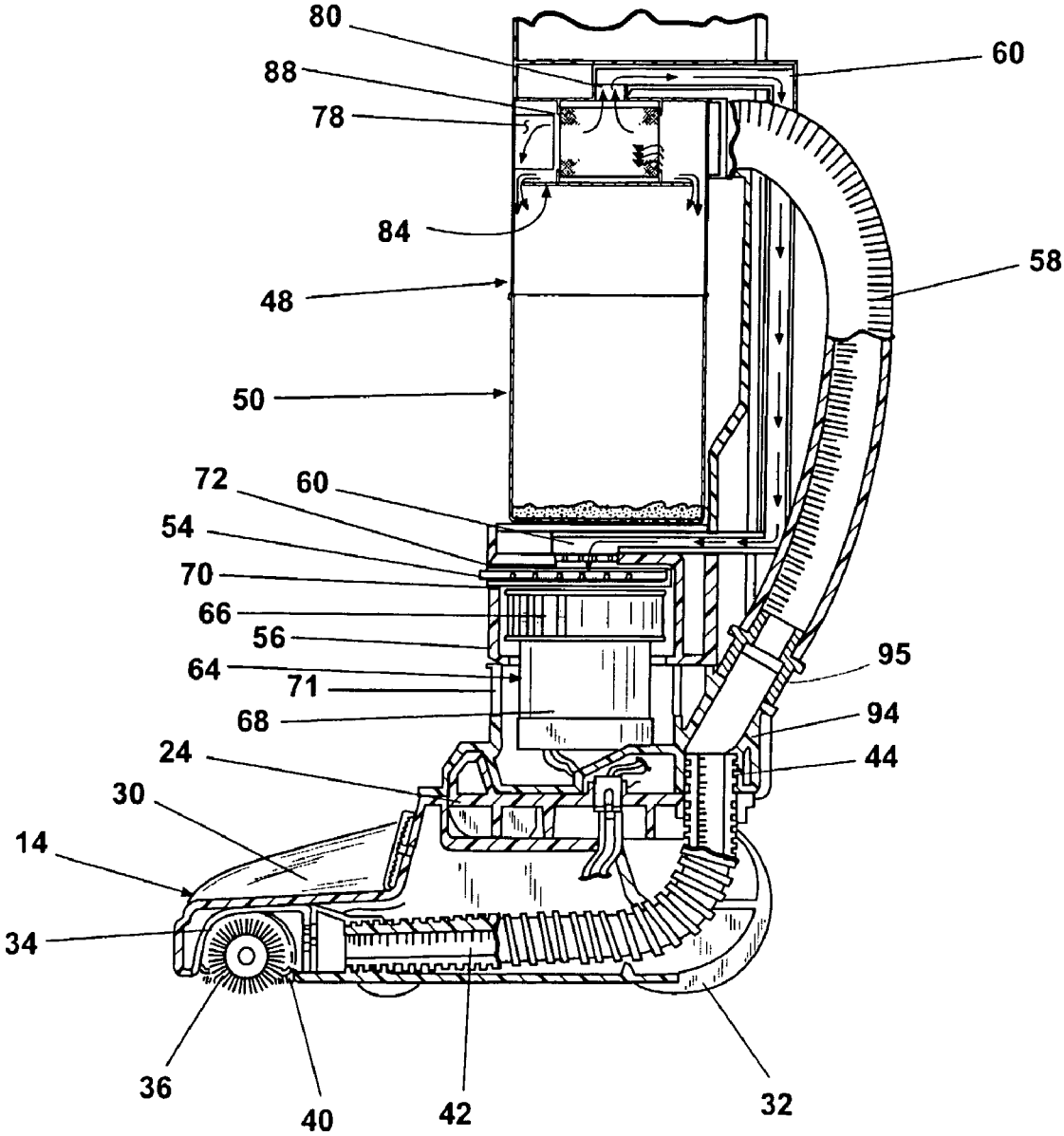
FIG. 3 is a partial sectional view of the vacuum module and the foot assembly taken along line 3-3 of FIG. 1.

Referring to FIGS. 1, 2 and 3, the foot assembly 14 comprises a foot housing 30, a pair of wheels 32, a brush chamber 34, and a working air path described in more detail herein. The brush chamber 34 comprises a cavity formed horizontally at a forward section of the foot housing 30 for receiving an agitator, such as a brush 36. The brush 36 is preferably a well known horizontal axis brush roll driven by a separate brush motor 106 (shown schematically in FIG. 7A) located within the foot housing 30. An electric switch 112 (shown schematically in FIG. 7A) on the detachable cyclonic vacuum module 16 or the handle assembly 12 selectively supplies power to the brush motor 106. A wheel axle 38 passes through the wheel axle bearings in the support tubes 20 and is rigidly fixed to both sides of the foot housing 30 to rotatably mount the pair of wheels 32 to the vacuum cleaner 10.

Referring to FIG. 3, the working air path in the foot assembly 14 is formed by a suction nozzle 40, a flexible working air conduit 42, and an air conduit coupling 44. The suction nozzle 40 is formed at a lower opening to the brush chamber 34, and a space between the brush 36 and the brush chamber 34 allows working air to pass through brush chamber 34 to the working air conduit 42. The flexible working air conduit 42 is fluidly connected to the suction nozzle 40 on one end and extends through the foot housing 30 before terminating at the air conduit coupling 44 on an upper rearward surface of the foot housing 30 to form an uninterrupted working air path through the foot housing 30 from the suction nozzle 40 to the air conduit coupling 44. A detailed description of a suitable foot assembly 14 and of a suitable mounting between the module platform 24 and the detachable cyclonic vacuum module 16 is disclosed in U.S. Pat. Nos. 5,524,321 and 5,309,600 to Weaver et al., which are incorporated herein by reference in their entirety.

Referring to FIGS. 1, 2 and 3, the detachable cyclonic vacuum module 16 comprises a module housing 46, a cyclonic separator 48, a removable dirt cup 50, a dirt cup latch 52, a filter tray assembly 54, a fan housing 56, an external hose 58, and an outlet air conduit 60. The module housing 46 supports various components of the detachable cyclonic vacuum module 16, such as the cyclonic separator 48, the removable dirt cup 50, and the fan housing 56. Although a cyclonic separator 48 is disclosed, it should be appreciated that any dirt separator or filters such as a commonly known bag filter can be used in lieu of the described cyclonic separator 48. The fan housing 56 can be integrally formed with the module housing 46 or a separate component attached to the module housing 46. A handle 62 integrally formed in at an upper surface of the module housing 46 provides a convenient location for a user to grasp the detachable cyclonic vacuum module 16 for lifting the detachable cyclonic vacuum module 16 from the module platform 24 and holding the detachable cyclonic vacuum module 16 when separated from the module platform 24.

Referring to FIG. 3, a fan motor assembly 64 mounted vertically within the fan housing 56 comprises a fan 66 located above a motor 68. The fan housing 56 includes a fan air inlet 70 in communication with an inlet to the fan 66 and a plurality of working air exhaust apertures 71 for directing working air exhaust from the fan 66 to the atmosphere. Optionally, a post motor filter can be placed between the fan motor assembly 64 and the exhaust apertures 71 to filter particles from the working air exhaust before the working air exhaust enters the atmosphere. The filter tray 54 is removably inserted into a corresponding cavity in the module housing 46 upstream of the fan air inlet 70 to filter particles from the working air before the working air enters the fan motor assembly 64. The filter tray 54 is a generally box like structure with solid sidewalls supported by a framework structure to create a permeable floor. A permeable foam pre-motor filter 72 fits within the filter tray 54 and is supported by the permeable filter tray floor. The foam filter 72 is air permeable so that the working air passes through an upper surface of the foam filter and exits through a lower surface of the foam filter 72. The filtered working air exits the foam filter 72 and passes through the filter tray floor to enter the fan inlet 70.

Figure 4:
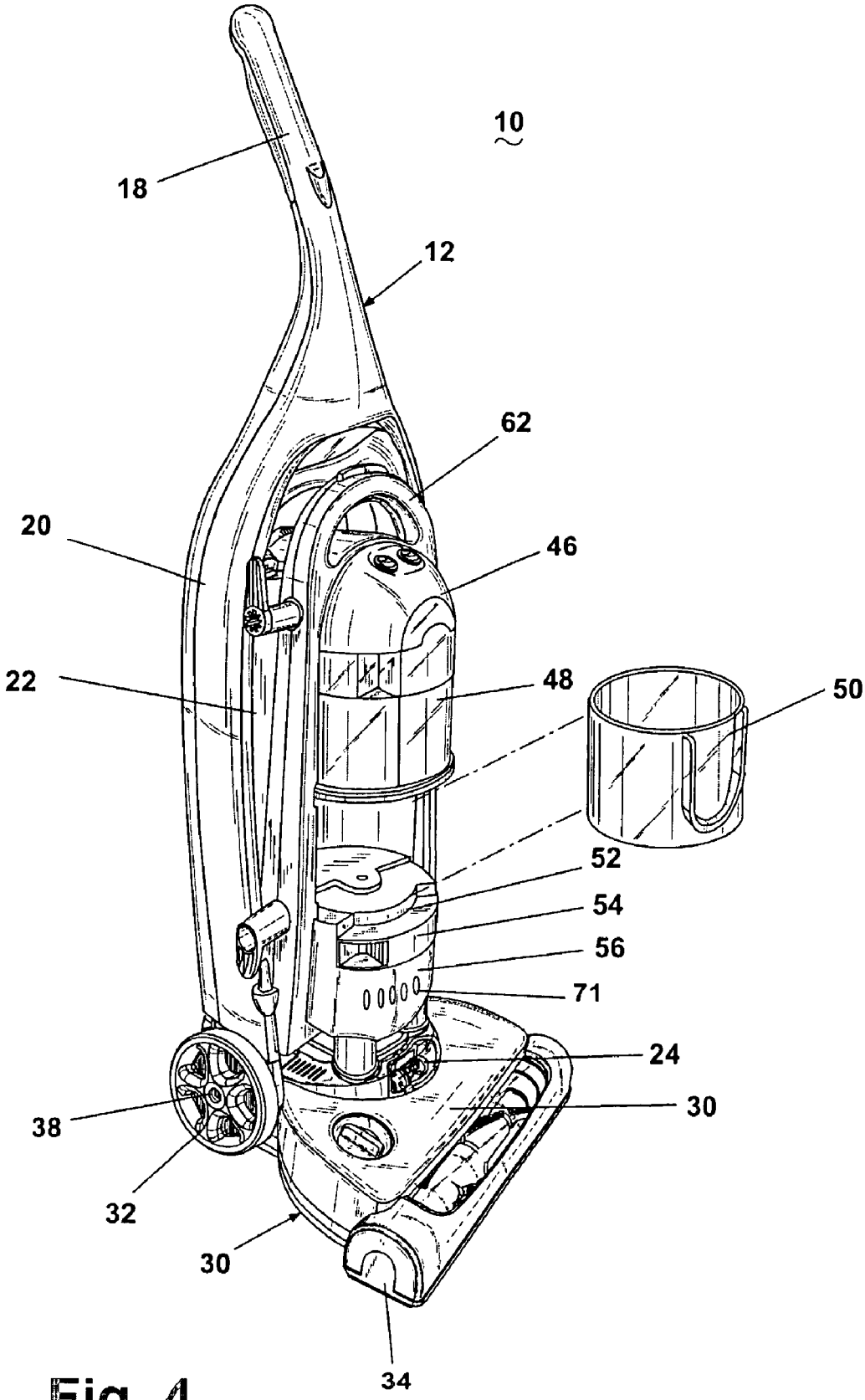
FIG. 4 is a perspective view similar to FIG. 1 with a dirt cup removed from the vacuum module.

Referring to FIG. 4, the dirt cup latch 52 removably secures the dirt cup 50 to the detachable cyclonic vacuum module 16. Preferably, the dirt cup latch 52 also positions the dirt cup 50 vertically within the detachable cyclonic vacuum module 16. In particular, the dirt cup latch 52 raises the dirt cup 50 within the detachable cyclonic vacuum module 16 so that an upper end of the dirt cup 50 seals with a lower end of the cyclonic separator 48. Examples of suitable dirt cup latches are disclosed in U.S. patent application Ser. No. 10/711,117 and U.S. Pat. No. 6,782,584, which are incorporated herein by reference in their entirety.

Figure 5:
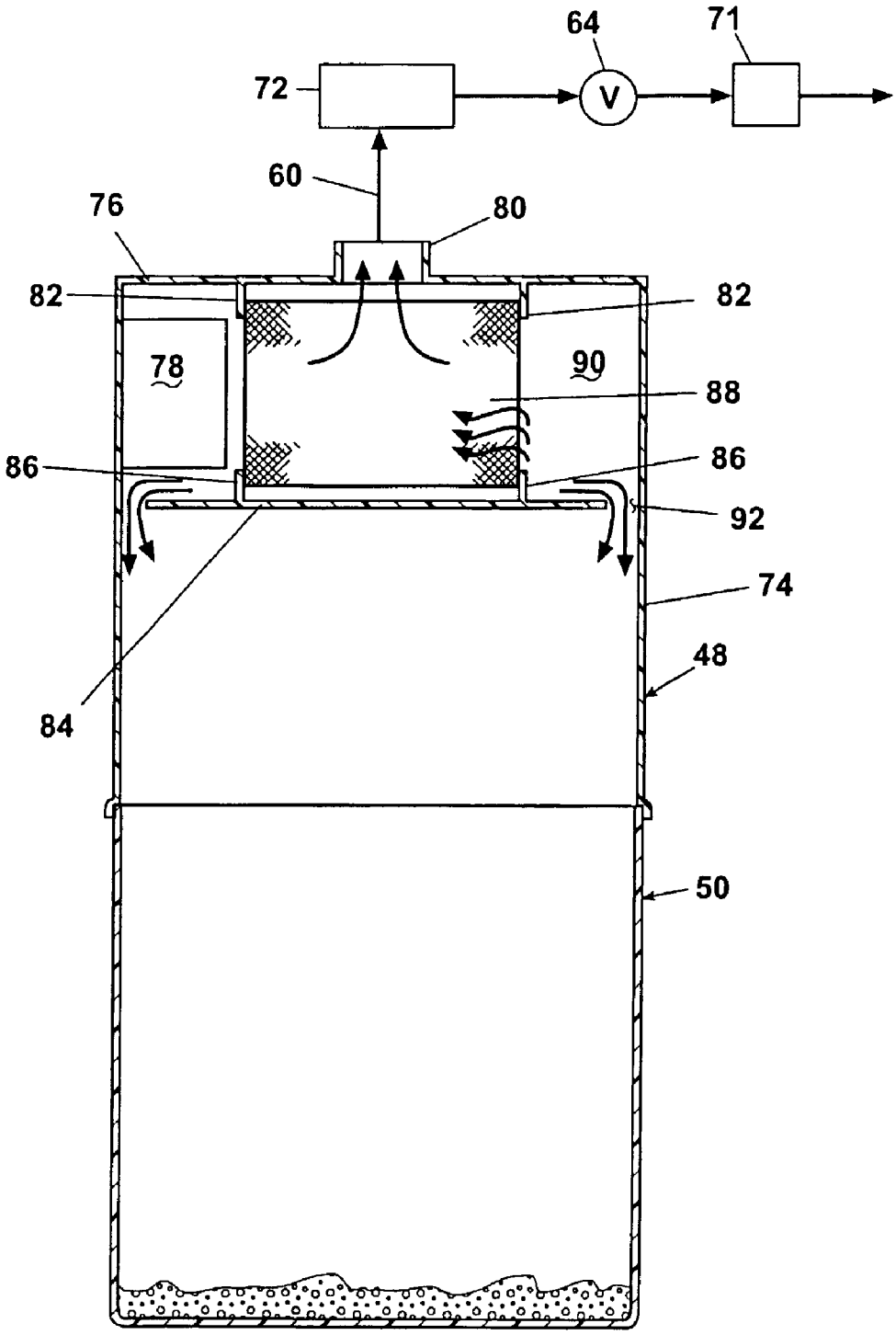
FIG. 5 is a sectional view of the cyclonic separator and the dirt cup of the vacuum module in FIG. 1.

Referring now to FIGS. 3 and 5, the cyclonic separator 48 comprises a cylindrical sidewall 74, a circular upper wall 76, and a cyclone air inlet aperture 78. The circular upper wall 76 comprises an exhaust outlet 80 having a centrally located aperture therethrough. A collar 82 depends from a lower surface of the upper wall 76. A separator plate 84 in the form of a solid disk having an upstanding annular collar 86 is suspended from the upper wall 76. In the preferred embodiment, the upstanding annular collar 86 is aligned with the depending collar 82 of the upper wall 76. A cylindrical screen 88 is retained between the collars 82, 86 and partially forms a toroidal chamber 90 that extends radially between the cylindrical screen 88 and the side wall 74 and vertically between the upper wall 76 and the separator plate 84. In the preferred embodiment, the air inlet aperture 78 is vertically positioned between the upper wall 76 and the separator plate 84 such that tangential working airflow through the air inlet aperture 78 is directed into the toroidal chamber 90.

With further reference to FIGS. 3 and 5, the tangential working airflow containing particulate matter passes through the inlet air aperture 78 and into toroidal chamber 90 and travels around the cylindrical screen 88. As the working air travels about the toroidal chamber 90, heavier dirt particles are forced toward the sidewall 74. These particles fall under the force of gravity through a gap 92 defined between an edge of the separator plate 84 and the sidewall 74. Referring particularly to FIG. 4, dirt particles that fall through the gap 92 collect in the dirt cup 50 located below the cyclonic separator 48. The upper end of the dirt cup 50 mates with the side wall 74 to seal the dirt cup 50 with the cyclone separator 48. As the working air traverses through the toroidal chamber 90, casting dirt particles towards the sidewall 74, the working air is drawn through cylindrical screen 88, through the exhaust outlet 80, and into an outlet air conduit 60. The outlet air conduit 60 is integrally molded in a rear wall of the module housing 46. Working air moves through the outlet air conduit 60 to the pre-motor filter 72. The pre-motor filter 72 removes additional particulate matter from the working air prior to the working air being drawn through the fan motor assembly 64. The optional post-motor filter located downstream of the fan motor assembly 64 removes additional fine particulate matter from the working air exhaust before the working air exhaust is released to the atmosphere. An example of a suction cleaner with cyclonic dirt separation is disclosed in U.S. Patent Application Publication No. 2002/0011050 to Hansen et al., which is incorporated herein by reference in its entirety.

As best seen in FIG. 3, one end of the external hose 58 of the detachable cyclonic vacuum module 16 is coupled to the inlet air aperture 78 of the cyclonic separator 48. The other end of the external hose terminates at a hose adapter 95 that can be removably attached to a hose fitting 94 in the form of a hollow conduit located at a lower rearward surface of the module housing 46. When the detachable cyclonic vacuum module 16 is mounted to the module platform 24, the hose fitting 94 couples with the air conduit coupling 44 in the foot assembly 14 to fluidly connect the working air conduit 42 in the foot assembly 14 with the external hose 58 of the detachable cyclonic vacuum module 16.

When the detachable cyclonic vacuum module 16 is attached to the upright handle assembly 12, the vacuum cleaner 10 can be operated as an ordinary upright vacuum cleaner. When power is applied to the fan motor assembly 64, the motor 68 turns the fan 66 to create a working airflow. Consequently, suction created at the suction nozzle 40 draws debris into the working air path. Dirt-laden working air flows through the working air conduit 42, the air conduit coupling 44, the hose fitting 94, into the hose 58, and through inlet air aperture 78 whereby the dirt laden air rotates within the cyclonic separator 48 to separate the dirt from the working air. The working air then passes through the cylindrical screen 88, through the exhaust outlet 80, through the outlet air conduit 60, and into the fan motor assembly 64 as previously described.

All of the elements that create suction and collect particles from the working air are contained within the detachable cyclonic vacuum module 16. As a result, the detachable cyclonic vacuum module 16 can be removed from the handle assembly 12 and the foot assembly 14 for use as a portable vacuum cleaner. As utilized herein, portable refers to use of the detachable cyclonic vacuum module 16 as a discrete unit separate from the handle assembly 12 and the foot assembly 14. When used as a portable vacuum cleaner, the detachable cyclonic vacuum module 16 can be used to clean a variety of surfaces, including above floor surfaces, such as upholstery, and floor surfaces, such as stairs. When the detachable cyclonic vacuum module 16 is detached from the upright handle assembly 12, the flexible hose 58 can be removed from the hose fitting 94 for attaching the upholstery tool 26 or other suitable tool to the hose adapter 95.

Figure 6:
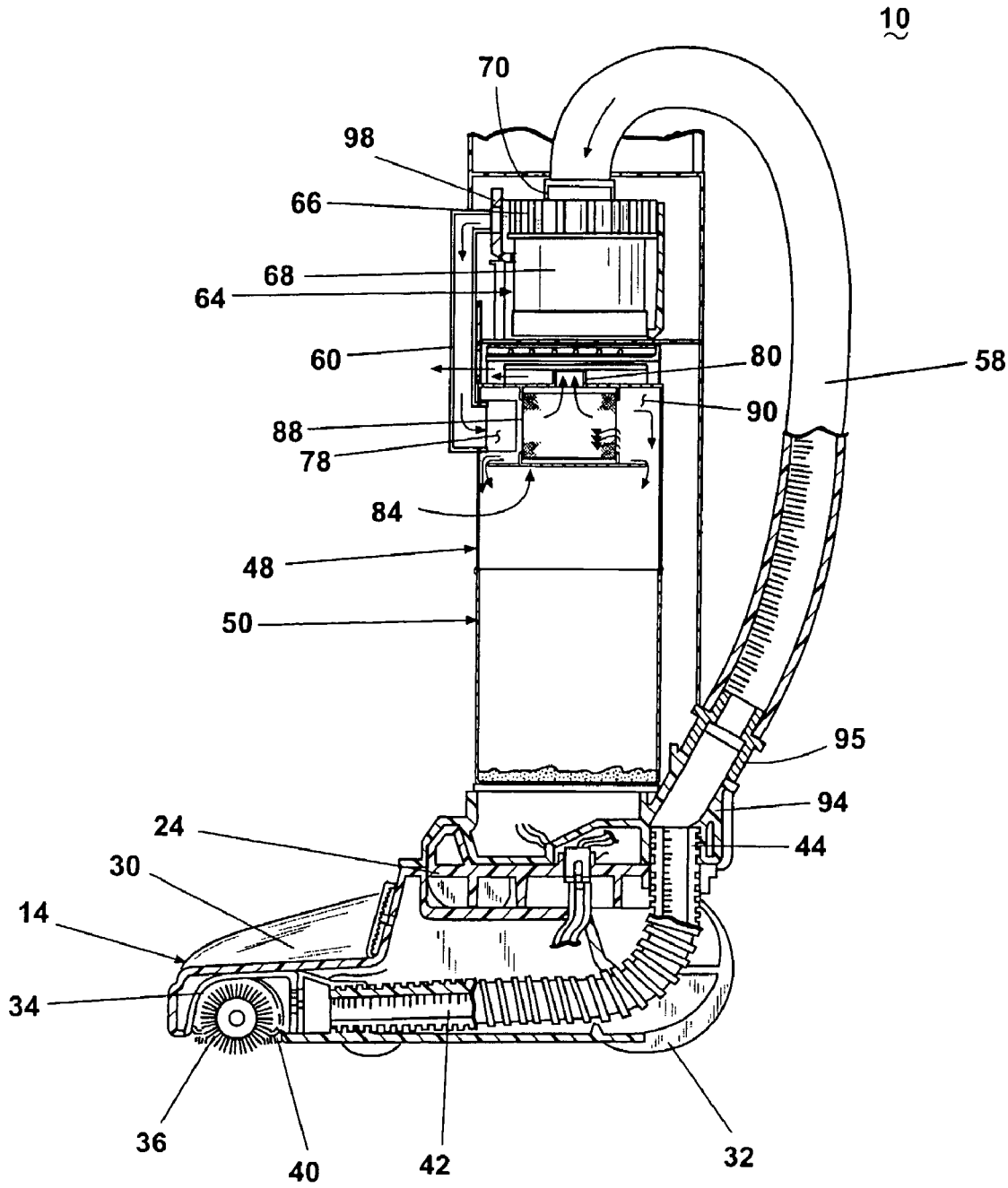
FIG. 6 is a schematic view similar to FIG. 3 of an alternative embodiment of a vacuum module according to the invention.

An alternative embodiment of a vacuum cleaner 10 according to the invention is illustrated in FIG. 6, where components similar to those of the first embodiment are identified with the same numerals. While the first embodiment vacuum cleaner 10 comprises what is commonly known in the vacuum cleaner art as a clean air system, the alternative embodiment vacuum cleaner 10 comprises what is commonly known in the vacuum cleaner art as a dirty air system. In particular, the vacuum cleaner 10 comprises a detachable cyclonic cleaning module 16 having a module housing 46, a cyclonic separator 48 with a cyclone separation toroidal chamber 90, a flexible suction conduit in the form of an external hose 58, and a fan motor assembly 64 having a fan 66 driven by a motor 68. The hose 58 is connected at one end to the module housing 46 and at an opposite end to a hose adapter 95 removably mounted in a hose fitting 94 that is adapted to mount into the air conduit coupling 44 when the detachable cyclonic cleaning module 16 is mounted to the module platform 24. As in the first embodiment, the hose 58 is freely movable when the detachable cyclonic cleaning module 16 is removed from the module platform 24. The fan motor assembly 64 is preferably located above the toroidal chamber 90 and has a fan air inlet 70 that is connected to the hose 58 and an outlet opening 98 that is connected to an air inlet aperture 78 of the toroidal chamber 90 by an air conduit 60. The cyclonic separator 48 is substantially identical to that of the first embodiment. A dirt cup 50 is mounted in the module housing 46 beneath the toroidal chamber 90 to collect dirt and dust separated from the working air in the toroidal chamber 90. The toroidal chamber 90 has an outlet 80 and an optional filter to remove remaining dirt and dust fines that are not separated from the working air in the toroidal chamber 90.

Figure 7A:
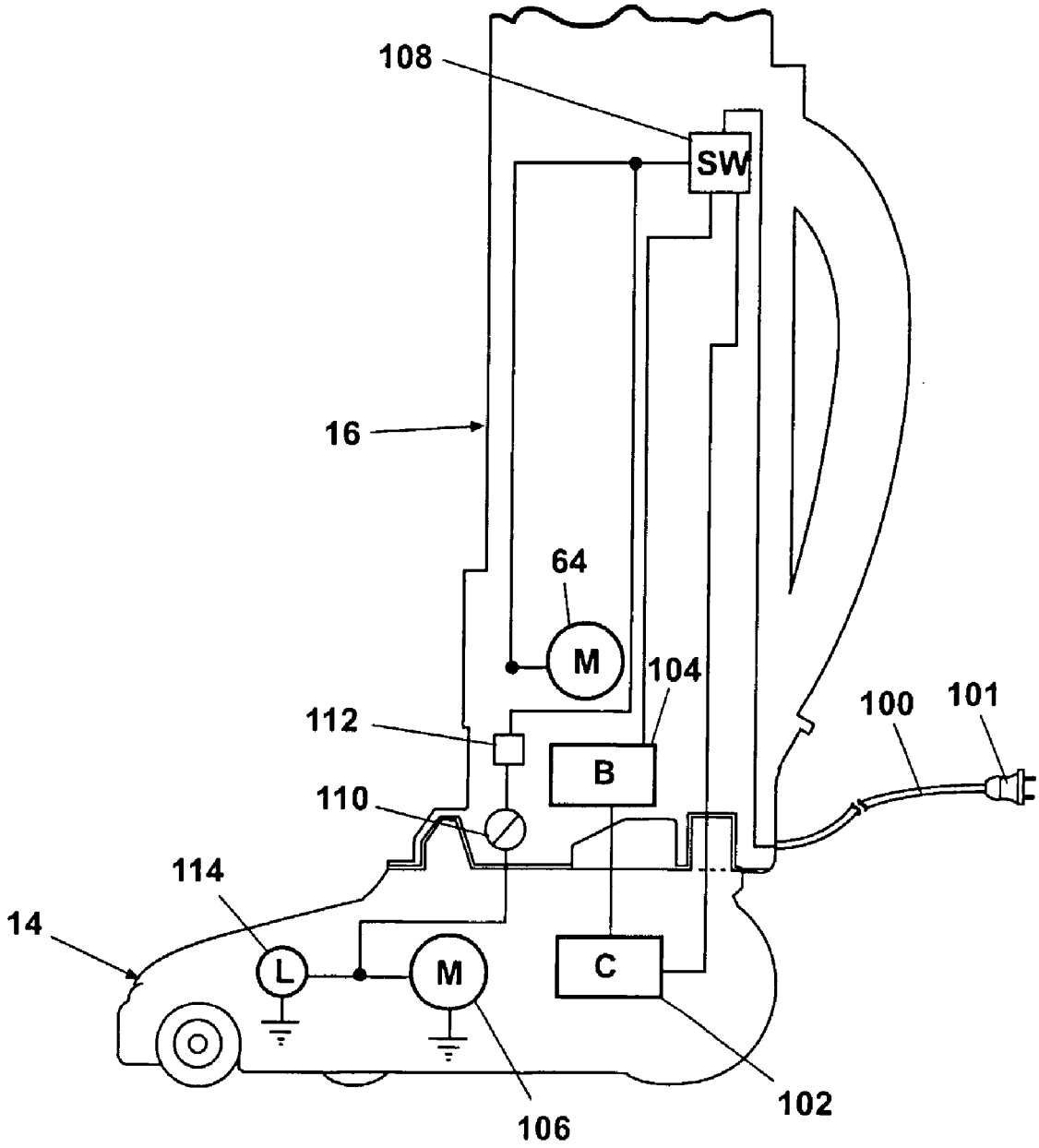
FIG. 7A is a schematic representation of the vacuum module and the foot assembly of FIG. 1 and an electrical system therefor.
Figure 7B:
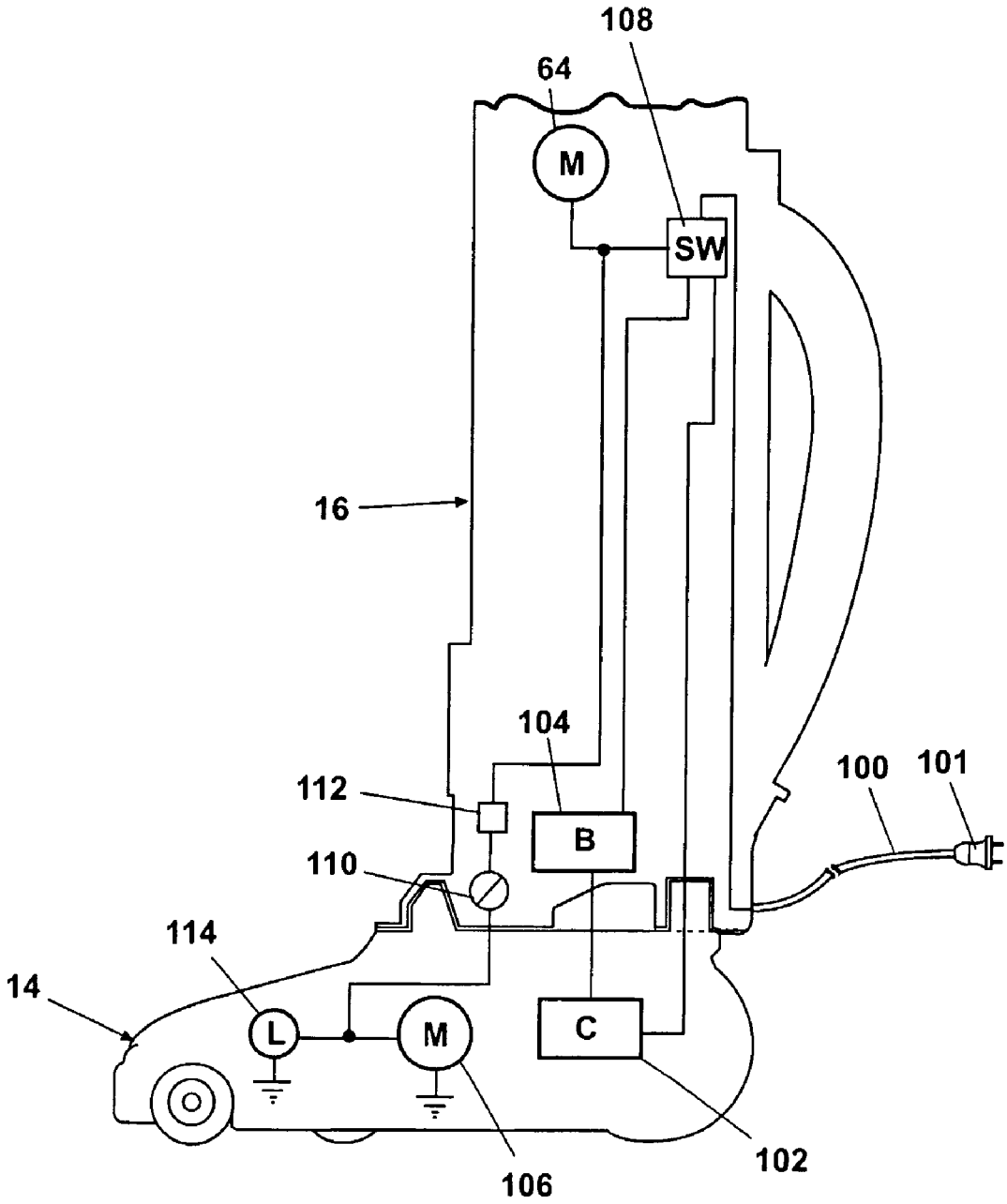
FIG. 7B is a schematic representation of the vacuum module and the foot assembly of FIG. 6 and an electrical system therefor.
Figure 8:
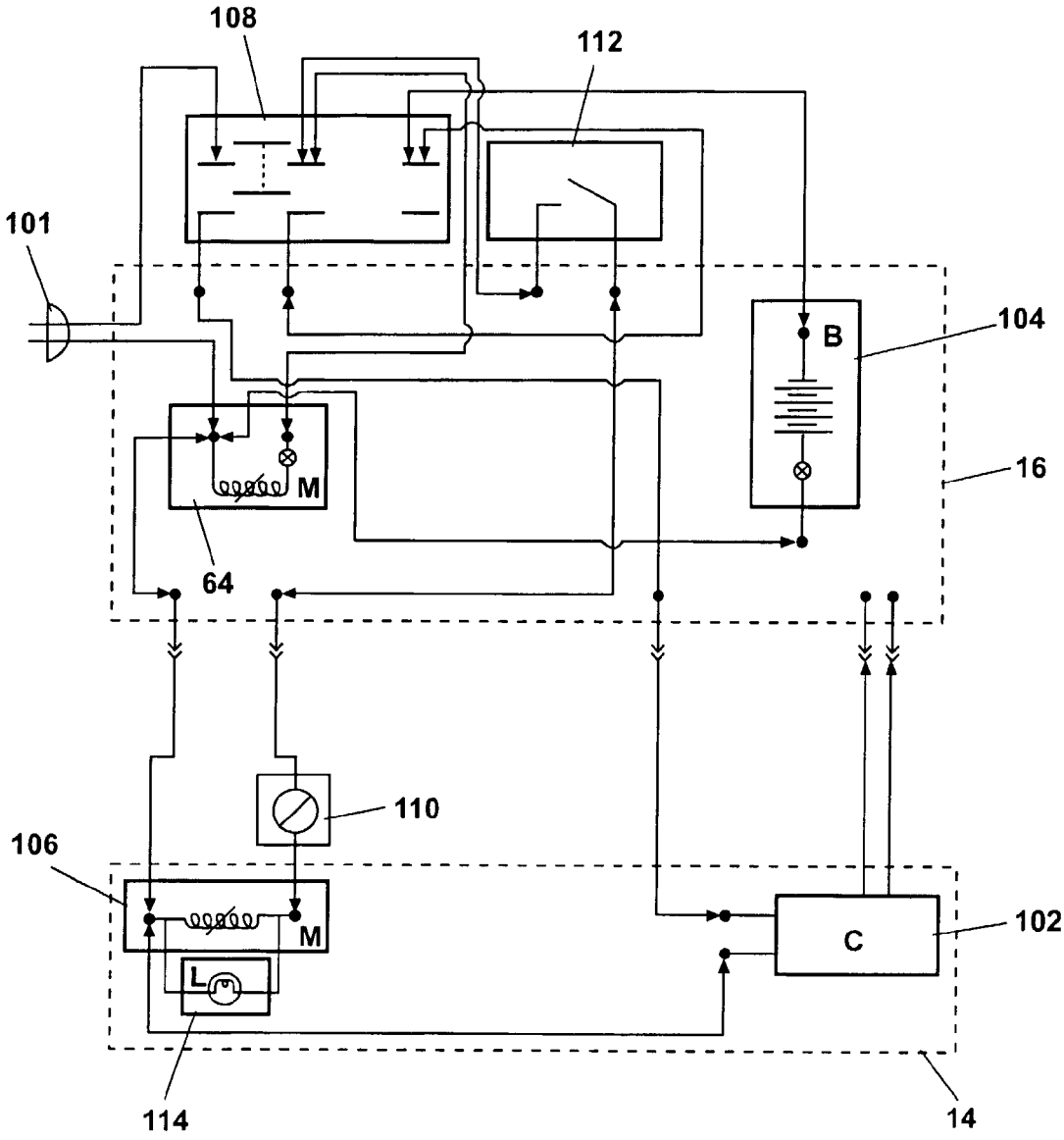
FIG. 8 is a schematic representation of the electrical system of the embodiments of the vacuum cleaner illustrated in FIGS. 1 and 6.

Referring now to FIGS. 7A, 7B, and 8, an electrical system for the vacuum cleaner 10 of the first embodiment (FIG. 7A) and the second embodiment (FIG. 7B) comprises a power cord 100 with an electrical contact plug 101 to interface with a stationary power source, as is well known in the vacuum cleaner art. As used herein, a stationary power source is a power source that cannot be readily moved by a user. The most common stationary power source is an electrical system having 120 Volt electrical outlets mounted to a wall of a building for receiving the plug 101. In the vacuum cleaner 10, the power cord 100 is connected to a charging unit 102 mounted in the foot assembly 14. The charging unit 102 can be any commonly known charging unit employing a transformer and a power control circuit board to convert 120 volt AC facility power into a DC voltage with an appropriate power rating. The power control circuit board of the charging unit 102 detects and controls power output from the charging unit 102. An example of a suitable charging and power control is disclosed in U.S. Pat. No. 6,457,205 to Conrad, which is incorporated herein by reference in its entirety. Alternatively, the transformer can be incorporated at the plug 101. A suitable commercially available rechargeable battery and charging system employing a plug mounted transformer is found on the BISSELL Homecare, Inc. Model 3300 Go-Vac rechargeable stick vacuum cleaner.

A portable power source in the form of a rechargeable battery pack 104 comprising a suitable number of power cells is removably mounted in the detachable cyclonic vacuum module 16. The cells can be any commonly known power cell, such as nickel cadmium (NiCad), lithium, or nickel metal hydride (NiMH). Optionally, the battery pack 104 can be replaceable so that the user can install a completely charged battery pack until the discharged battery is fully charged or in the case the battery pack 104 is unable to hold a sufficient charge. An exemplary battery pack is described in the aforementioned U.S. Pat. No. 6,457,205 to Conrad. The portable power source can be any suitable device that can power the vacuum cleaner 10 without a physical connection to a stationary power source.

When the detachable cyclone cleaning module 16 is mounted to the module platform 24, the battery pack 104 is electrically connected to the charging unit 102 for charging the battery back 104. Current from the battery pack 104 flows to the vacuum fan motor assembly 64 in the detachable cyclonic vacuum module 16 and to the brush motor 106 located in the foot assembly 14. A main switch 108 controls current flow from the battery pack 104 to the fan motor assembly 64. A brush motor interlock switch 110 positioned on the upright handle assembly 12 is normally open and closes when the detachable cyclonic vacuum module 16 is mounted to the handle assembly 12 so that current can flow from the main switch 108 and through a brush switch 112 to the brush motor 106. The main switch 108 and the brush switch 112 can be manually operated by the user; the user closes the main switch 108 to power to the fan motor assembly 64 and the brush switch 112 to power the brush motor 106. The brush motor 106 is in a powered state when the main switch 108, the interlock switch 110, and the brush switch 112 are all closed. An optional illumination lamp 114 affixed to a forward surface of the foot assembly 14 is wired in parallel to the brush motor 106 and illuminates when the brush switch 112 is closed and the main switch 108 is closed.

As described previously, the vacuum cleaner 10 can be used in two operating modes: as a conventional upright vacuum when the detachable cyclonic vacuum module 16 is attached to the handle assembly 12 and as a portable vacuum cleaner when the detachable cyclonic vacuum module 16 is separate from the handle assembly 12. In either operational mode, power can be delivered to the electrical components directly from the stationary power source through the power cord 100 whereby the vacuum cleaner 10 is utilized as a conventional wired product. Alternatively, when the battery pack 104 is sufficiently charged, the vacuum cleaner 10 can be used in a wireless mode. When the vacuum cleaner 10 is used in the wireless mode, the battery pack 104 supplies power to the fan motor assembly 64, the brush motor 106, and the lamp 114 when the corresponding switches are closed, and the power cord 100 can be conveniently stored on the detachable cyclonic vacuum module 16, such as by being wrapped around conventional cord wraps. When the vacuum cleaner 10 is utilized as a portable vacuum cleaner in the wireless mode, the vacuum cleaner 10 is especially easy to transport during use since the detachable cyclonic vacuum module 16 is not bound to the handle assembly 12, the foot assembly 14, or to the stationary power source through the power cord 100.

Figure 9A:
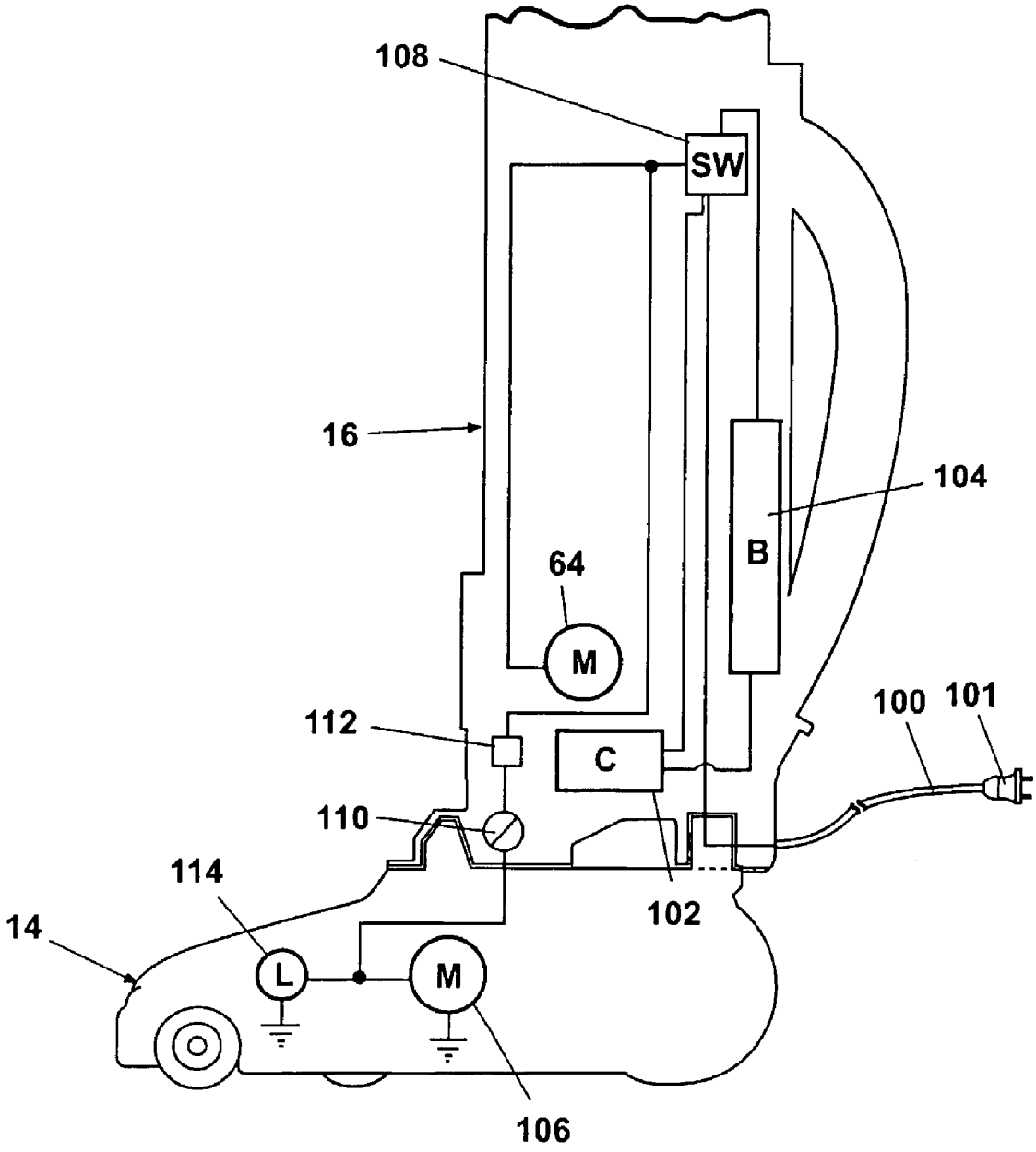
FIG. 9A is a schematic view similar to FIG. 7A with an alternative electrical system.
Figure 9B:
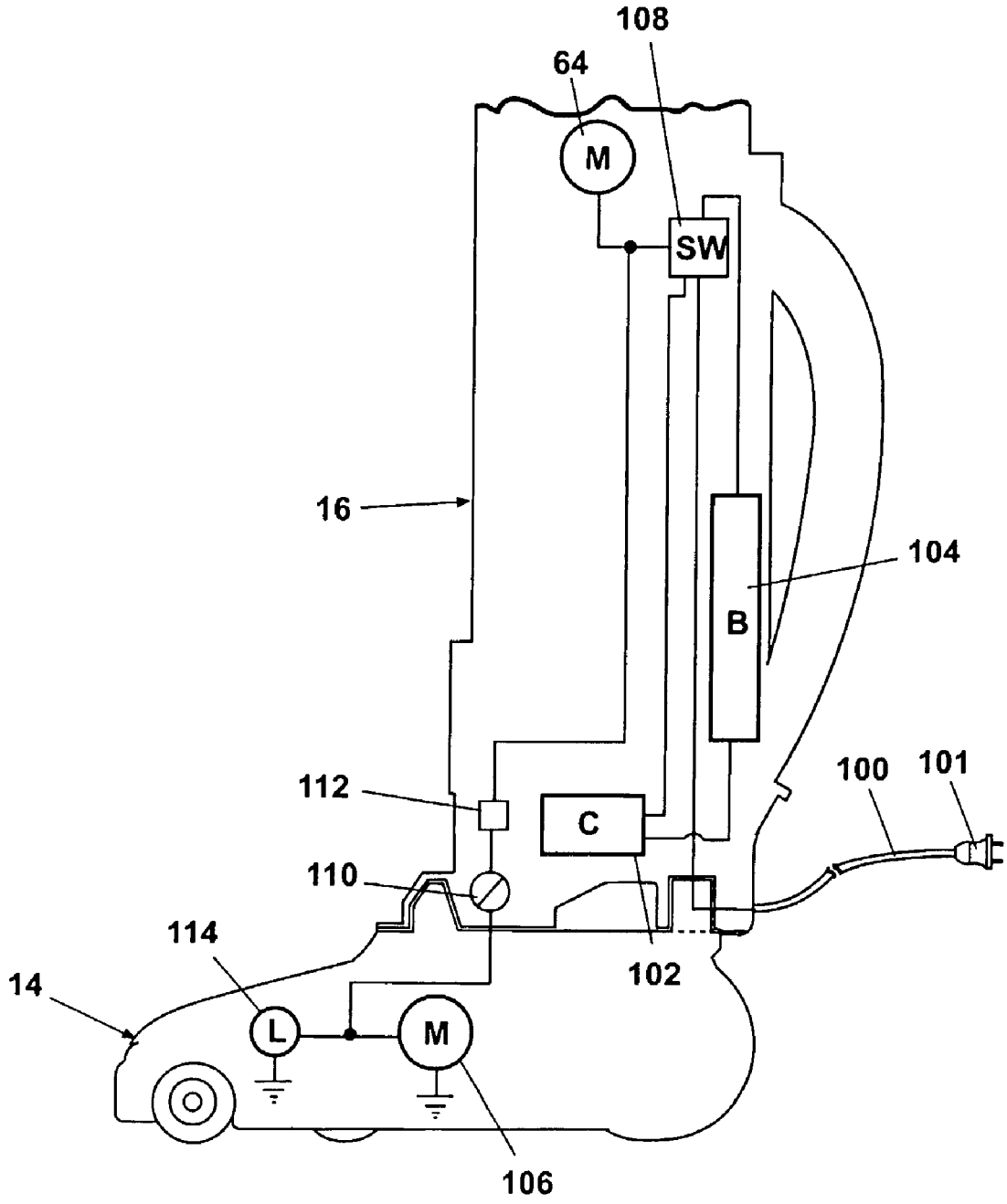
FIG. 9B is a schematic view similar to FIG. 7B with an alternative electrical system.

Referring to FIGS. 9A (first embodiment vacuum cleaner 10) and 9B (second embodiment vacuum cleaner 10), the charging unit 102 and battery pack 104 of an alternative electrical system are both located in the detachable cyclonic vacuum module 16. Hence, the battery pack 104 can be charged while the detachable cyclonic vacuum module 16 is separated from the handle assembly 12. As in the previous embodiments, either power mode (wired or wireless) can be utilized in either the upright or portable vacuum cleaner operational modes.

Figure 10A:
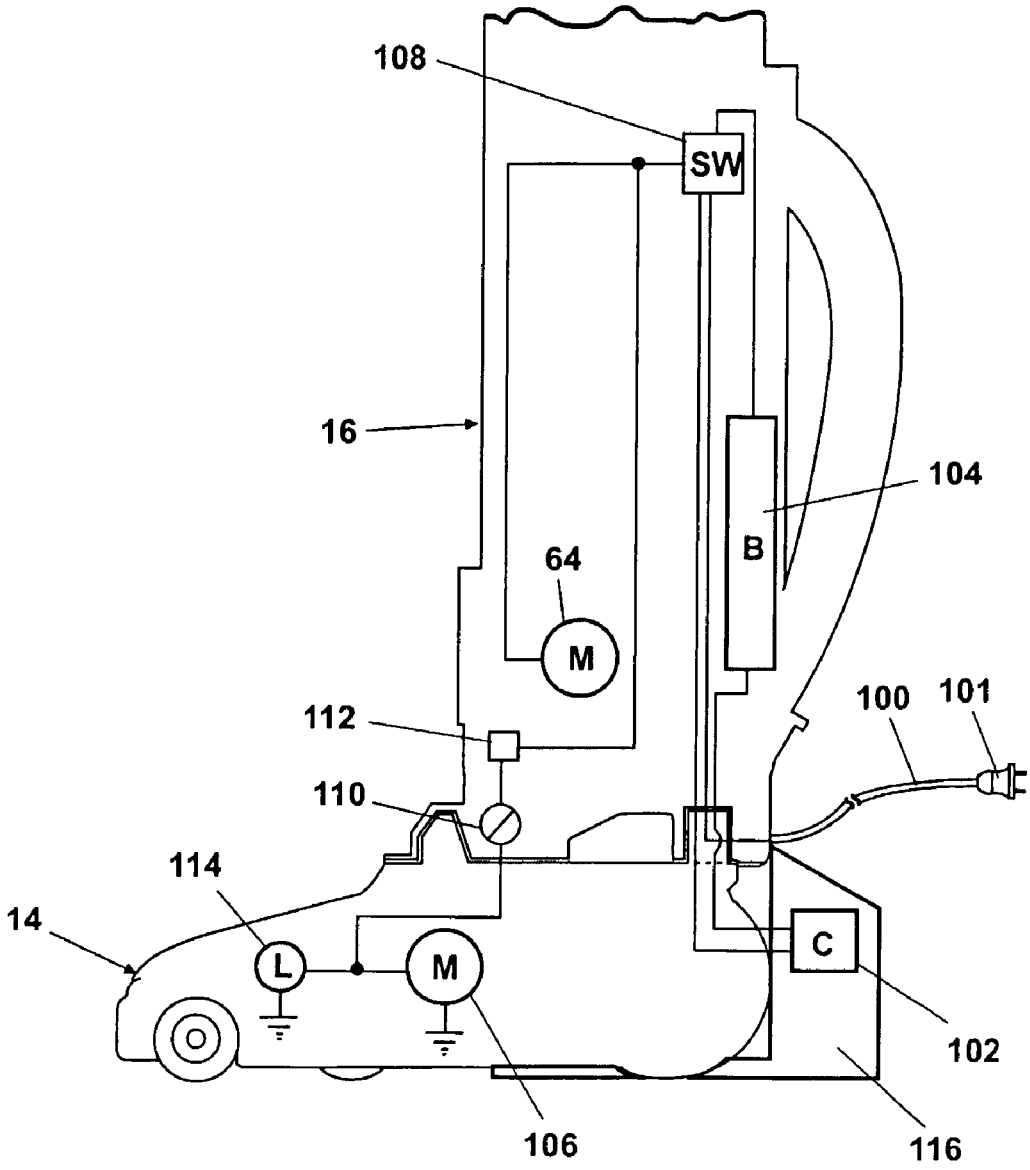
FIG. 10A is a schematic view similar to FIG. 7A with a second alternative electrical system.
Figure 10B:
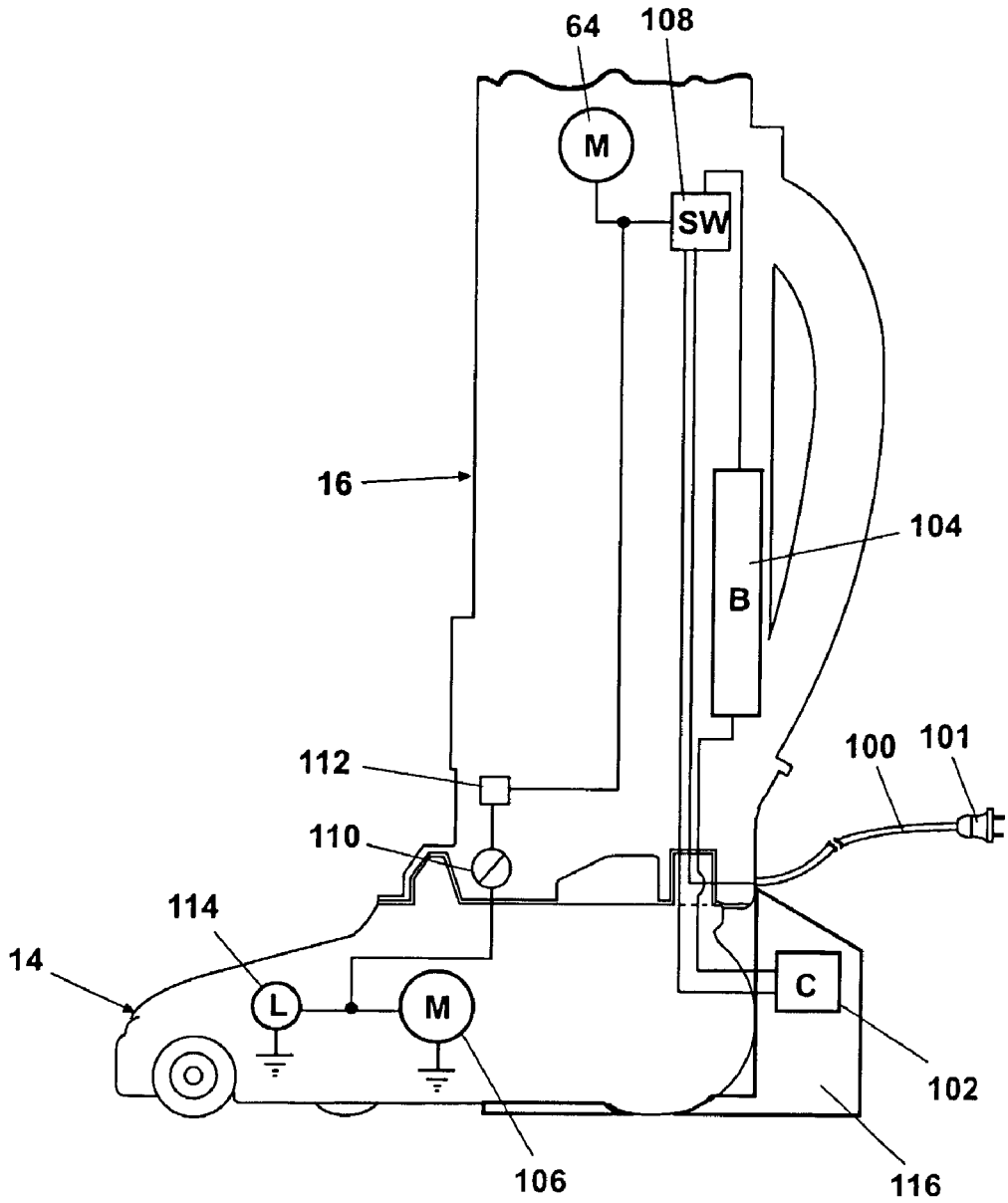
FIG. 10B is a schematic view similar to FIG. 7B with a second alternative electrical system.

Referring to FIGS. 10A (first embodiment vacuum cleaner 10) and 10B (second embodiment vacuum cleaner 10), the charging unit 102 of another alternative electrical system is located in a separate charging base 116 to which the foot assembly 14 can dock when the handle assembly 12 is in the upright configuration. When the foot assembly 14 is docked to the charging base 116, the charging unit 102 is in electrical communication with the battery pack 104. An example of this type of charging system is disclosed in U.S. Pat. No. 6,684,451 to Kato, which is incorporated herein by reference in its entirety.

While the invention has been specifically described in connection with certain embodiments thereof, it is to be understood that this is by way of illustration and not of limitation. For example, the cyclonic separator can be replaced with another type of separator, including, but not limited to, a filter bag or a separator having a primary cyclone separation stage and downstream secondary cyclone separation stage. Additionally, the dirt cup can be any suitable container or a plurality of containers for collecting particles and other matter separated from the working air flow. The dirt cup can be positioned in any suitable location relative to the cyclone separator and can be removed from the vacuum cleaner or emptied in any suitable fashion. Reasonable variation and modification are possible within the scope of the forgoing description and drawings without departing from the spirit of the invention, which is described in the appended claims.

What is claimed is:

1. A vacuum cleaner comprising:

a foot assembly having a suction nozzle;

an upright handle assembly pivotally mounted to the foot assembly for manipulation of the foot assembly along a surface to be cleaned; and a portable cleaning module detachably mounted to the handle assembly so that the vacuum cleaner can be operated as an upright vacuum cleaner when the portable cleaning module is mounted to the handle assembly or as a portable vacuum cleaner when the portable cleaning module is detached from the handle assembly, the portable cleaning module comprising:

a module housing;

a particle separator mounted to the module housing and having an inlet;

a suction conduit having a first end connected to the inlet of the cyclone separator and a second end removably coupled to the suction nozzle;

a motor and fan assembly supported in the module housing for creating a working air flow from the suction nozzle to the cyclone separator through the suction conduit; and a portable power source coupled to the motor and fan assembly for supplying power to the motor and fan assembly when the portable cleaning module is detached from the handle assembly for operation of the vacuum cleaner as a portable vacuum cleaner.

2. The vacuum cleaner according to claim 1 wherein the portable power source is adapted to supply power to the motor and fan assembly when the portable cleaning module is mounted to the handle assembly for operation of the vacuum cleaner as an upright vacuum cleaner.

3. The vacuum cleaner according to claim 1 wherein the portable power source comprises a battery pack.

4. The vacuum cleaner according to claim 3 wherein the battery pack comprises a rechargeable battery.

5. The vacuum cleaner according to claim 1 and further comprising a charging unit mounted in one of the foot assembly and the portable cleaning module and selectively coupled to the portable power source for charging the portable power source.

6. The vacuum cleaner according to claim 5 and further comprising a transformer in electrical communication with the charging unit and a stationary power source for converting alternating current from the stationary power source to direct current for the portable power source.

7. The vacuum cleaner and charging base assembly comprising a vacuum cleaner according to claim 1 and a charging base to which the foot assembly removably docks, the changing base comprising a charging unit that connects to the portable power source for charging the power source when the foot assembly is docked with the charging base.

8. The vacuum cleaner according to claim 1 and further comprising an agitator driven by an agitator motor, both mounted to the foot assembly, and the portable cleaning module comprises an interlock switch in communication with the agitator motor, wherein the interlock switch closes when the portable cleaning module is mounted to the handle assembly to electrically couple the portable power source with the agitator motor.

9. The vacuum cleaner according to claim 8 and further comprising a user operated agitator switch between the portable power source and the interlock switch for controlling power to the agitator motor.

10. The vacuum cleaner according to claim 9 and further comprising a user operated main power switch between the portable power source and agitator switch.

11. The vacuum cleaner according to claim 9 and further comprising a lamp mounted to the foot assembly and electrically connected to the interlock switch so that the portable power source supplies power to the lamp when the portable cleaning module is mounted to the handle assembly and the agitator switch is closed.

12. The vacuum cleaner according to claim 1 and further comprising a user operated main power switch between the portable power source and the motor and fan assembly for controlling power to the motor and fan assembly.

13. The vacuum cleaner according to claim 12 and further comprising a power cord coupled to the main power switch and having a plug that can be removably coupled to a stationary power source for providing power to the motor and fan assembly.

14. The vacuum cleaner according to claim 13 wherein the power cord is mounted to the portable cleaning module.

15. The vacuum cleaner according to claim 13 wherein the power cord is arranged in parallel relative to the portable power supply.

16. The vacuum cleaner according to claim 1 wherein the particle separator further comprises an outlet opening and the motor and fan assembly includes an inlet opening connected to the outlet opening of the particle separator for drawing the working air flow through the particle separator.

17. The vacuum cleaner according to claim 1 wherein the motor and fan assembly comprises an inlet opening connected to the first end of the suction conduit and an outlet opening connected to the inlet opening of the particle separator.

18. The vacuum cleaner according to claim 1 wherein the foot assembly further comprises an air conduit coupling and a working air conduit coupled to the suction nozzle at a first end and to the air conduit coupling at a second end, and wherein the portable cleaning module further comprises a hose fitting that removably receives the second end of the suction conduit and mates with the air conduit coupling when the portable cleaning module is mounted to the handle assembly to fluidly communicate the suction nozzle with the particle separator.

19. The vacuum cleaner of any of claim 1 wherein the portable cleaning module further comprises a cyclone separator.

20. The vacuum cleaner according to claim 19 wherein the portable cleaning module further comprises a dirt cup removably mounted to the module housing to collect particles separated from the working air flow by the cyclone separator.

21. The vacuum cleaner according to claim 20 wherein the dirt cup is mounted below the cyclone separator.

22. The vacuum cleaner according to any of claim 1 wherein the cleaning module comprises a bag filter.

* * * * *